US005136967A

United States Patent [19]

Sollinger et al.

[11] Patent Number: 5,136,967

[45] Date of Patent: Aug. 11, 1992

[54] MEANS FOR CLEANING DOCTOR DEVICE FOR SPREADER

[75] Inventors: Hans-Peter Sollinger; Zygmunt Madrzak, both of Heidenheim, Fed. Rep. of Germany

[73] Assignee: J. M. Voith GmbH, Fed. Rep. of Germany

[21] Appl. No.: 622,505

[22] Filed: Dec. 5, 1990

[30] Foreign Application Priority Data

Dec. 7, 1989 [DE] Fed. Rep. of Germany ..... 3940450

[51] Int. Cl.[5] ..... B05C 11/04

[52] U.S. Cl. ..... 118/104; 15/256.51; 118/126; 118/261; 118/413; 118/419

[58] Field of Search ..... 118/104, 126, 261, 410, 118/413, 419; 15/256.51; 134/1

[56] References Cited

U.S. PATENT DOCUMENTS

| | | | |
|---|---|---|---|
| 4,220,113 | 9/1980 | Wohlfeil | 118/126 |
| 4,369,731 | 1/1983 | Damrau | 118/410 |
| 4,716,829 | 1/1988 | Wenzel | 134/1 X |

*Primary Examiner*—Michael G. Wityshyn

*Attorney, Agent, or Firm*—Ostrolenk, Faber, Gerb & Soffen

[57] ABSTRACT

In order to clean the support region at the bottom end of a doctor element which is clamped to a support and is thereby held to the surface of spreadable material to be doctored, the leaf spring doctor element is removable from a stop on the support against which the leaf spring is clamped in operation by a plate pusher. The support is shaped to have a groove extending along the width of the stop and the support for the doctor element. A sidewall of the groove is defined in a ledge that is movable along the support and along the groove. The sidewall supports oscillation pulse transmitters. A liquid pulse transmitting medium in the groove transmits the oscillations across the grove to the area of the leaf spring support to be cleaned. The oscillation pulse transmitters may be a series of transmitters extending along the sidewall along the groove or may comprise a long bar shaped oscillator which is oscillated at its ends. Bearing pedestals at spaced intervals corresponding to the oscillation nodes may support the bar shaped oscillator.

24 Claims, 2 Drawing Sheets

MEANS FOR CLEANING DOCTOR DEVICE FOR SPREADER

BACKGROUND OF THE INVENTION

The present invention relates to a doctor device for a spreader, and particularly to means for cleaning the seat of the doctor element.

A doctor device for a spreader is known from U.S. Pat. No. 4,369,731. During operation of these doctor devices, particles of residue of the spreading composition they are spreading seat firmly in the slot in which the spreading blade is pressed, and particularly against the stop which holds the blade fast. These residues prevent a dependable seating of the spreading blade in its mount. The possibilities for cleaning the seat of the spreading blade are rather poor in such cases.

In a device that has gained acceptance, the spreading blade is clamped by a pneumatic pressure hose. The aforementioned U.S. patent also is an example of this. Such devices make the possibilities of cleaning even poorer.

SUMMARY OF THE INVENTION

It is an object of the invention to enable cleaning of the seat of a spreader blade or doctor element or blade in such a way that during the changing of the blades, while the blade is absent from its seat, the blade seat can be cleaned within a very short time.

This object is achieved in accordance with the invention. The cleaning means of the present invention is used in association with a doctor device for cleaning the seat where the doctor element or blade is supported in position. The doctor device includes a doctor element, which is usually in the form of a leaf spring, and which at its bottom end is removably supported to a support. The support includes a stop at which the leaf spring doctor element is removably held. A clamping means or element, preferably in the form of a plate pusher which may be retracted as required, acts upon and clamps the leaf spring in position in its seat and against the stop. The plate pusher is retractable away from the leaf spring doctor element and away from the stop thereby freeing the doctor element to be removed from and replaced on the stop and support. There is additionally a pressure applying element which applies pressure on the doctor element to press its upper spreading edge against the surface on which material is to be doctored.

In order to clean the support region at the bottom end of the doctor element, which is clamped to the doctor element support and is thereby held to the surface of spreadable material to be doctored, the leaf spring doctor element is removable from the stop and from the support against which the leaf spring is clamped in operation by the plate pusher. The support for the doctor element is shaped to have a groove extending along the width of the stop and the support for the doctor element. A sidewall of the groove is defined on a ledge that is movable along the support and along the groove. The sidewall may support oscillation pulse transmitters at the groove or such a transmitter or transmitters may be disposed in the groove of the support. A liquid pulse transmitting medium in the groove transmits the oscillations across the groove to the area of the leaf spring support to be cleaned. The oscillation pulse transmitters may be a series of transmitters extending along the sidewall of the ledge, along the groove, or may comprise a long bar shaped oscillator which is oscillated by oscillation causing means at one or both the ends of the bar. Bearing pedestals at spaced intervals corresponding to the oscillation nodes may support the bar shaped oscillator.

Other features and advantages of the present invention will become apparent from the following description of the invention which refers to the accompanying drawings.

BRIEF DESCRIPTION OF THE DRAWINGS

The invention will be described below on basis of two embodiments shown in the drawing, in which FIGS. 1 and 2 each show a cross section through a doctor device according to the invention.

DETAILED DESCRIPTION OF THE PREFERRED EMBODIMENTS

Figure 1:
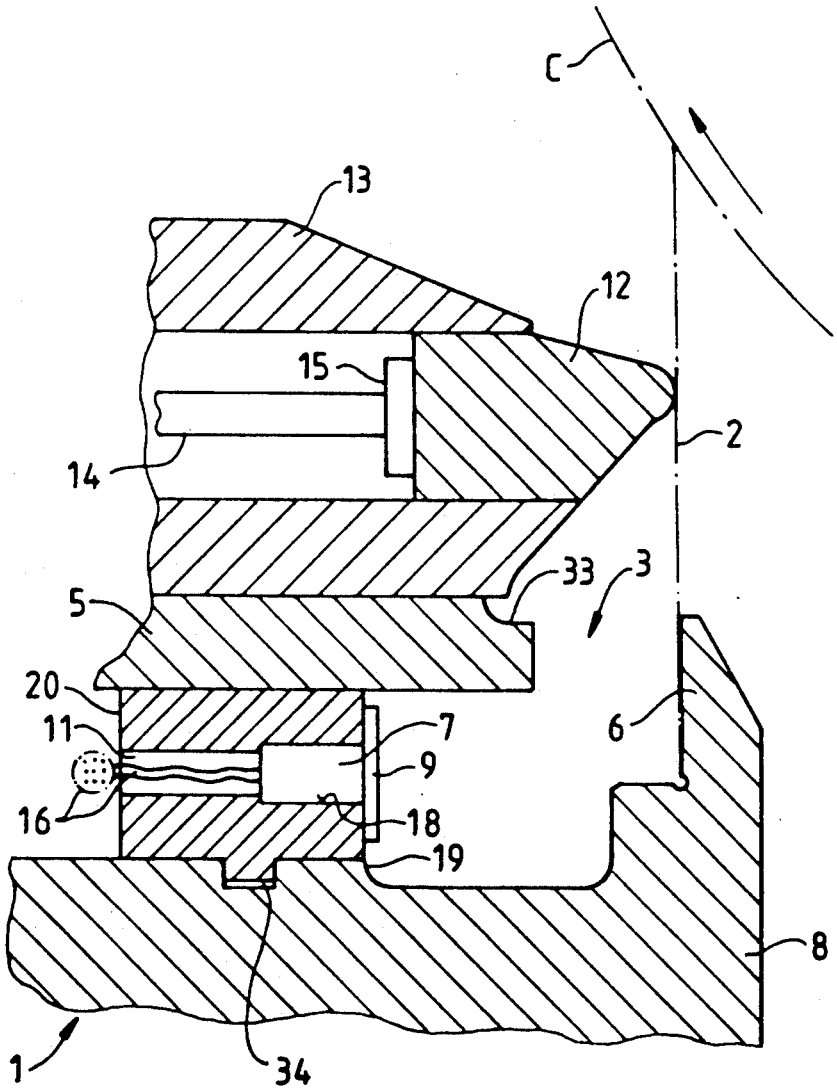

In FIG. 1, the doctor device 1 acts in cooperation with the roll C to doctor a material (not shown) on the surface of the roll. The direction of movement of the surface of the roll is indicated by the arrow. The doctor device is carried on a fixed support 8. At its upper part at the side closer to the roll C the support 8 has a stop 6 for the leaf spring that serves as a spreading blade 2, and which has been shown in dot-dash line since the blade 2 is not to be present upon the cleaning of the doctor device. The stop 6 and the blade 2 extend across the width of the roll C.

Figure 2:
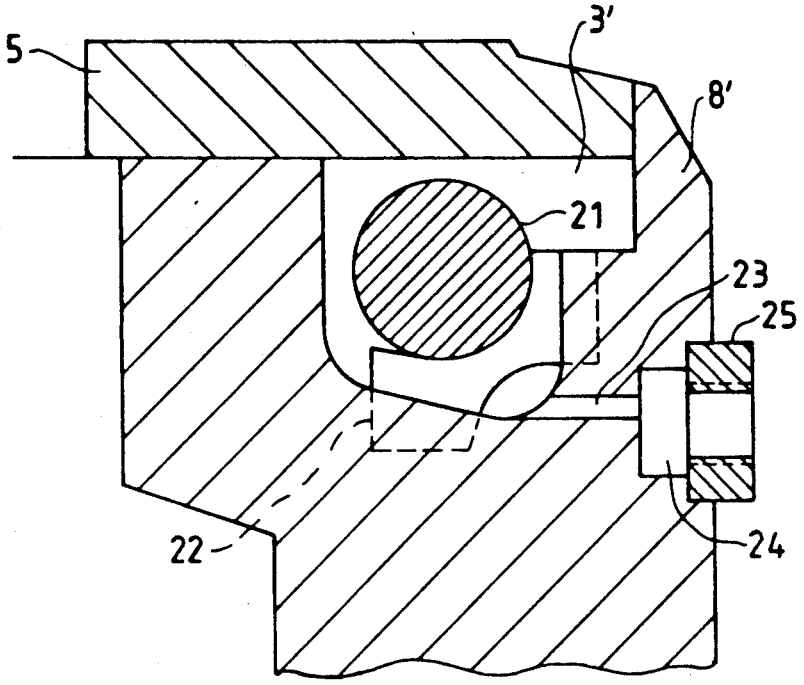

During a spreading operation, the spreading blade 2 is pressed against the stop 6 by means of the plate pusher 5. In FIG. 1, the plate pusher 5 is shown retracted (to the left) away from the stop 6 on the support 8, because the spring 2 is absent and need not be clamped. In FIG. 2, in contrast, the plate pusher 5' is forward in the leaf spring clamping position. The plate pusher 5 is provided in its upper part with a groove 33 which extends parallel to the stop 6 and to the spreading blade 2.

The spreading blade 2 is pressed by the pointed end of a pressure ledge 12 against the mating roll C by a reciprocating device, of which only the reciprocation rod 14 and the attachment plate 15 to the ledge 12 are shown. An upper guide plate 13 is provided for the guidance of the pressure ledge 12.

The support 8 includes a sidewall 19 which is opposite the stop 6. Between the sidewall 19 and the stop 6 and the support 8, a groove 3 is defined for containing an oscillation transmission medium, in the form of a liquid preferably, such as water.

There is a ledge 20 supported above the support 8 and a tongue in groove connection at 34 enables that ledge to be shifted on the support along the length of the groove 3. The sidewall 19 is defined at the side of the ledge 20.

A plurality of oscillation pulse elements 7 are located in the sidewall 19 in a row extending parallel to the groove 3 across the width of the roll C and the blade 2. The electrical connections for the elements 7 are contained in a channel 11 which also extends parallel to the groove 3. The electrical cables are indicated at 16. The oscillation elements 7 terminate substantially flush with the sidewall 19 of the groove 3. The elements 7 are covered by an oscillation plate or membrane 9 disposed on the outside of the sidewall. If there is a distance across the width of the sidewall 19 between the individual oscillation elements 7 of, for instance, about 20 cm, then one oscillation plate 9 can be provided for each oscillation element 7.

The oscillation pulse exciter elements 7 can operate preferably on a piezoelectric basis. In that case, they are developed substantially as small round cylinders which can be inserted and bonded in corresponding cylindrical channels 18 across the body above the support 8. In such case, no oscillation plates 9 may under certain conditions be required. The oscillation elements are either piezoelectric or magnetostrictive in nature. It is also possible to arrange the oscillation exciters, which can be for instance ultrasonic transmitters 7, at a greater distance apart. But then the ledge 20 is provided which is displaceable parallel to the groove 3. This ledge is moved back and forth during the cleaning process so that the entire region of the seat of the spreading blade is exposed to ultrasonic waves.

For enabling cleaning, the plate 5 is retracted as shown. The groove 3 is filled, for instance, with water at least over the bottom of the stop 6 and the seat for the spring 2 and preferably up over a substantial part of the stop. If the oscillation exciters 7 are now placed in oscillation, preferably at ultrasonic frequency, such as 20 to 80 kHz, the particles of dirt which have deposited in the groove 3 and, in particular, at the edge of the plate pusher 5 and of the stop 6 are loosened. The dirt can be washed away by introducing water continuously into the groove.

To retain the water in the groove 3, the groove is closed off by closure plates (not shown) at both ends, in the region of the two lateral ends of the roll C. These closure plates can be provided with connections for the water. At least one of these closure plates may also be developed as a flap which by means of a rubber packing seals off the end wall of the groove. This flap can be opened slightly so that the cleaning water can flow away continuously, corresponding to the excess amount of water added. When the cleaning process has ended, no further water is added, and the closure flap may be opened completely so that the water present in the groove, including the dirt contained in it, flows off.

Cleaning during operation of the spreader, and therefore during the spreading with the existing spreading blade, may be possi' 'e. This could be meaningful since it may avoid development of larger deposits in the region of the seat of the spreading blade.

It is not necessary for the doctor element to be a spreading blade. Instead, a roller doctor guided in a doctor bed and held by a blade-like holder can also be used. This blade-like holder, for instance a leaf spring, can also be fastened in a blade mount developed in the manner shown.

FIG. 2 shows an arrangement having an oscillator 21 which is developed as a bar of circular cross section and which extends along the entire length of the doctor groove 3'. The length of the oscillator 21, therefore, corresponds essentially to the length of the spreading blade or of a leaf spring which holds the roller-doctor. Otherwise, parts in FIG. 2 which are similar to the parts shown in FIG. 1 have been provided with the same reference numeral, with the addition of a prime mark.

Preferably, oscillator 21 is constructed of material, such as titanium, having a high modulus of elasticity.

The oscillator 21 is supported by bearing pedestals 22 comprised of plastic, such as polyurethane, distributed over the length of the oscillator 21. These pedestals 22 are preferably located at at least some of the oscillation nodes of the bar oscillator 21.

Figure 3:
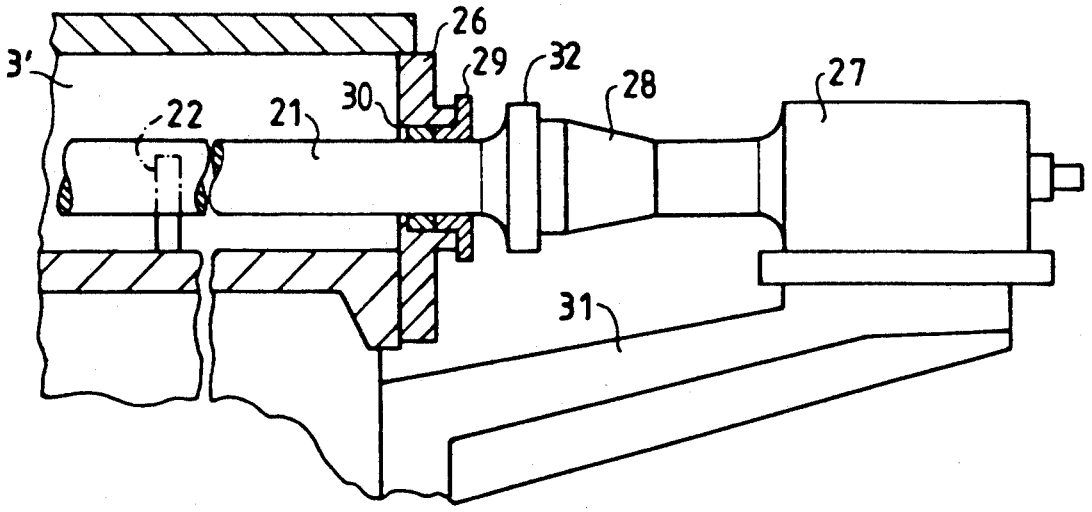
FIG. 3 is a partial outer view in longitudinal section of the doctor device shown on a smaller scale.

Oscillation of the bar 2 is caused by an oscillation exciter 27, 28, which is coupled to the end of the bar and is mounted on a bracket 31 as shown in FIG. 3. An oscillation exciter can also be coupled to both ends of the bar shaped oscillator. The oscillation frequencies can be between 20 and 80 kHz. Bar 21 and its oscillation exciter can also carry out a transverse movement, for instance, in the longitudinal direction of the leaf spring or doctor groove 3' so that all points of the doctor groove are passed over by the sonic waves. A connection for liquid, in particular water, is indicated as pipe connection 25. The central opening of the connection 25 is continued by the space 24 and the channel 23 into the doctor groove 3'. Several such connections can be provided, and they are distributed over the length of the doctor groove 3'.

The oscillation exciter may comprise an element 27 with magnetostriction which is connected via a coupling piece 28, a so-called booster, for amplitude matching, to the oscillator 21. Joints (not shown) with flange and attachment screws and/or bonding can also be provided on both ends of the coupling piece. A seal formed by lead-through 30 surrounding oscillator 21 is provided in the end wall 26 of the doctor groove 3'. The seal is pressed on by a gland 29. The oscillation exciter can also be fastened on the holding flange 32.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Cleaning means for a doctor device for a spreader, the doctor device comprising a support, a doctor element removably connected to the support and extending up to a surface on which spread material is being doctored by the doctor element, the doctor element having a spreading edge remote from the area of the doctor element where the doctor element is connected to the support; a clamping element supported by the support and movable into engagement with the doctor element remote form the spreading edge of the doctor element, and a stop on the support, the clamping element pressing the doctor element against the stop, and the stop also being at least part of the means by which the doctor element is connected with the support, wherein the cleaning means comprises:

a groove disposed in the region of the support near the stop for the doctor element and where the doctor element is connected with the support, the support in said region being shaped for defining said groove which extends along the width of the stop and across the doctor element, said stop partially defining said groove, and said clamping element being movable across said groove to press the doctor element against the stop;

oscillation producing means for producing oscillation pulses, the oscillation producing means also extending along the groove, the oscillation producing means being remote from the doctor element, and being disposed below the clamping element; and means for causing oscillation pulses to be generated by the oscillation producing means for transmitting oscillation pulses to a pulse transmitting medium in the groove, the medium being in communication with the oscillation producing means and with the stop in the region at which the doctor element may be connected.

2. The cleaning means of claim 1, wherein the oscillation producing means comprises a row of separated independently operating oscillation pulse transmitters extending along the groove.

3. The cleaning means of claim 2, wherein the groove is further defined by a sidewall at the support and extending along the groove and being spaced from the stop, the oscillation pulse transmitters being disposed in and along the sidewall.

4. The cleaning means of claim 3, further comprising a ledge supported on the support and movable along the support generally parallel to the direction of the groove, and the sidewall of the groove being included on the ledge, the ledge being placed so that the sidewall is located generally opposite the stop and across the groove, and the oscillation pulse transmitters being disposed in the ledge and communicating through the sidewall into the groove.

5. The cleaning means of claim 1, wherein the oscillation producing means comprises a long bar shaped oscillator extending over a substantial length of the groove.

6. The cleaning means of claim 5, wherein means for causing oscillation pulses to be generated are coupled to the bar shaped oscillator at at least one end of the bar shaped oscillator.

7. The cleaning means of claim 5, wherein the bar shaped oscillator is comprised of a material of a high modulus of elasticity.

8. The cleaning means of claim 7, wherein the bar shaped oscillator is comprised of titanium.

9. The cleaning means of claim 5, wherein the bar shaped oscillator is so supported at the groove so as to be movable back and forth along the length direction of the bar shaped oscillator and generally parallel to the groove.

10. The cleaning means of claim 9, further comprising a plurality of bearing pedestals in the groove for providing support to the bar shaped oscillator at a few spaced locations of the bar shaped oscillator along the groove and along the oscillator.

11. The cleaning means of claim 5, further comprising a plurality of bearing pedestals in the groove for providing support to the bar shaped oscillator at a few spaced locations of the bar shaped oscillator along the groove and along the oscillator.

12. The cleaning means of claim 1, wherein the doctor element comprises a leaf spring extending from the stop, past the clamping element to a surface on which spread material is to be doctored.

13. The cleaning means of claim 12, wherein the clamping element comprises a movable plate pusher, located substantially in the upper region of the groove above the bottom of the groove for pressing the leaf spring against the stop and also against the surface on which the spreadable material is being doctored.

14. The cleaning means of claim 1, wherein the clamping element comprises a movable plate pusher, located substantially in the upper region of the groove above the bottom of the groove for pressing the doctor element against the stop and also against the surface on which the spreadable material is being doctored.

15. The cleaning means of claim 1, wherein the oscillation producing means comprise oscillation pulse transmitters in the form of piezo elements with transmitter frequencies of between 20 and 80 kHz, and electric means connected with the oscillation producing means for activating the oscillation producing means to oscillate at said frequencies.

16. The cleaning means of claim 1, wherein the oscillation producing means comprise oscillation pulse transmitters in the form of magnetostrictive elements with transmitter frequencies of between 20 and 80 kHz, and electric means connected with the oscillation producing means for activating the oscillation producing means to oscillate at the said frequencies.

17. The cleaning means of claim 1, further comprising means permitting delivery of an oscillation transmission liquid medium into the groove.

18. Cleaning means for a doctor device for a spreader, the doctor device comprising a support, a doctor element removably connected to the support and extending up to a surface on which spread material is being doctored by the doctor element, the doctor element having a spreading edge remote from the area of the doctor element where the doctor element is connected to the support; a clamping element supported by the support and movable into engagement with the doctor element remote form the spreading edge of the doctor element, and a stop on the support, the clamping element pressing the doctor element against the stop, and the stop also being at least part of the means by which the doctor element is connected with the support, wherein the cleaning means comprises:

a groove which extends along the width of the stop and across the doctor element, said groove being defined by the support in the region thereof near the stop for the doctor element and where the doctor element is connected with the support;

oscillation producing means for producing oscillation pulses, the oscillation producing means also extending along the groove, the oscillation producing means being remote from the doctor element;

means for causing oscillation pulses to be generated by the oscillation producing means for transmitting oscillation pulses to a pulse transmitting medium in the groove, the medium being in communication with the oscillation producing means and with the stop in the region at which the doctor element may be connected;

said oscillation producing means comprising a row of separated independently operating oscillation pulse transmitters extending along the groove;

said groove being further defined by a sidewall at the support and extending along the groove and being spaced from the stop, the oscillation pulse transmitters being disposed in and along the sidewall; and a ledge supported on the support and movable along the support generally parallel to the direction of the groove, and the sidewall of the groove being included on the ledge, the ledge being placed so that the sidewall is located generally opposite the stop and across the groove, and the oscillation pulse transmitters being disposed in the ledge and communicating through the sidewall into the groove.

19. The cleaning means of claim 18, further comprising oscillating plates over the oscillation pulse transmitters at the sidewall for oscillating in response to the oscillations of the oscillation pulse transmitters and thereby for generating oscillating vibrations in a medium in the groove.

20. Cleaning means for a doctor device for a spreader, the doctor device comprising a support, a doctor element removably connected to the support and extending up to a surface on which spread material is being doctored by the doctor element, the doctor element having a spreading edge remote from the area of the doctor element where the doctor element is connected to the support; a clamping element supported by the support and movable into engagement with the doctor element remote form the spreading edge of the doctor element, and a stop on the support, the clamping element pressing the doctor element against the stop, and the stop also being at least part of the means by which the doctor element is connected with the support, wherein the cleaning means comprises:

a groove which extends along the width of the stop and across the doctor element, said groove being defined by the support in the region thereof near the stop for the doctor element and where the doctor element is connected with the support;

oscillation producing means for producing oscillation pulses, the oscillation producing means also extending along the groove, the oscillation producing means being remote from the doctor element;

means for causing oscillation pulses to be generated by the oscillation producing means for transmitting oscillation pulses to a pulse transmitting medium in the groove, the medium being in communication with the oscillation producing means and with the stop in the region at which the doctor element may be connected;

said oscillation producing means comprising a long bar shaped oscillator extending over a substantial length of the groove;

said bar shaped oscillator being supported at the groove so as to be movable back and forth along the length direction of the bar shaped oscillator and generally parallel to the groove; and a plurality of bearing pedestals in the groove for providing support to the bar shaped oscillator at a few spaced locations of the bar shaped oscillator along the groove and along the oscillator.

21. The cleaning means of claim 20, wherein the bar shaped oscillator has a plurality of oscillation nodes along its length and the locations of the bearing pedestals for the bar shaped oscillator and the location of the oscillator are selected so that the pedestals are at at least a few of the oscillation nodes of the bar shaped oscillators.

22. Cleaning means for a doctor device for a spreader, the doctor device comprising a support, a doctor element removably connected to the support and extending up to a surface on which spread material is being doctored by the doctor element, the doctor element having a spreading edge remote from the area of the doctor element where the doctor element is connected to the support; a clamping element supported by the support and movable into engagement with the doctor element remote form the spreading edge of the doctor element, and a stop on the support, the clamping element pressing the doctor element against the stop, and the stop also being at least apart of the means by which the doctor element is connected with the support, wherein the cleaning means comprises:

a groove which extends along the width of the stop and across the doctor element, said groove being defined by the support in the region thereof near the stop for the doctor element and where the doctor element is connected with the support;

oscillation producing means for producing oscillation pulses, the oscillation producing means also extending along the groove, the oscillation producing means being remote from the doctor element;

means for causing oscillation pulses to be generated by the oscillation producing means for transmitting oscillation pulses to a pulse transmitting medium in the groove, the medium being in communication with the oscillation producing means and with the stop in the region at which the doctor element may be connected;

said oscillation producing means comprising a long bar shaped oscillator extending over a substantial length of the groove; and a plurality of bearing pedestals in the groove for providing support to the bar shaped oscillator at a few spaced locations of the bar shaped oscillator along the groove and along the oscillator.

23. The cleaning means of claim 22, wherein the bar shaped oscillator has a plurality of oscillation nodes along its length and the locations of the bearing pedestals for the bar shaped oscillator and the location of the oscillator are selected so that the pedestals are at at least a few of the oscillation nodes of the bar shaped oscillator.

24. The cleaning means of claim 23, wherein the bearing pedestals are comprised of plastic.

* * * * *